US007841866B2

(12) United States Patent
Hsu et al.

(10) Patent No.: US 7,841,866 B2
(45) Date of Patent: Nov. 30, 2010

(54) ELECTRICAL CONTACT HAVING STAMPED CONTACT PINS MOVABLY ASSEMBLED WITHIN ENCLOSURE MEMBER THEREOF

(75) Inventors: Hsiu-Yuan Hsu, Tu-Cheng (TW); Ke-Hao Chen, Tu-Cheng (TW)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 12/569,915

(22) Filed: Sep. 30, 2009

(65) Prior Publication Data

US 2010/0159753 A1 Jun. 24, 2010

(30) Foreign Application Priority Data

Sep. 30, 2008 (TW) ..... 97217541

(51) Int. Cl.
*H01R 12/00* (2006.01)

(52) U.S. Cl. ..... 439/66; 439/841

(58) Field of Classification Search ..... 439/66, 439/824, 284, 841, 700
See application file for complete search history.

(56) References Cited

U.S. PATENT DOCUMENTS 4,385,754 A * 5/1983 Waite ..... 267/71
4,973,030 A * 11/1990 Leonard ..... 267/71
6,396,293 B1 * 5/2002 Vinther et al. ..... 324/761
6,462,567 B1 * 10/2002 Vinther et al. ..... 324/754
6,743,043 B2 6/2004 Yamada
6,966,783 B2 * 11/2005 Hachuda et al. ..... 439/66
7,025,602 B1 * 4/2006 Hwang ..... 439/66
7,256,593 B2 * 8/2007 Treibergs ..... 324/754
7,467,952 B2 * 12/2008 Hsiao et al. ..... 439/66
7,520,754 B1 * 4/2009 Gattuso ..... 439/66
7,677,901 B1 * 3/2010 Suzuki et al. ..... 439/66

* cited by examiner

*Primary Examiner*—Briggitte R Hammond
(74) *Attorney, Agent, or Firm*—Andrew C. Cheng; Wei Te Chung; Ming Chieh Chang

(57) ABSTRACT

An electrical contact comprises an enclosure member having a tubular portion defining grooves on thereof, an upper contact pin movable assembled on one end of the enclosure member, a lower contact pin movable assembled on another end of the enclosure member, and a spring inserted within the enclosure member and between the upper and lower contact pins. The upper contact pin has a base portion, an upper contacting portion extending upwardly from the base portion, and a pair of supporting slides extending outwardly from two sides of the base portion. The lower contact pin comprises a main body, a lower contacting portion extending downwardly from the main body, and a pair of supporting slides extending outwardly from two sides of the main body. The supporting slides of the upper contact pin and the lower contact pin being received in the grooves of the enclosure member and movable up and down along the grooves in a vertical direction.

19 Claims, 5 Drawing Sheets

ELECTRICAL CONTACT HAVING STAMPED CONTACT PINS MOVABLY ASSEMBLED WITHIN ENCLOSURE MEMBER THEREOF

BACKGROUND OF THE INVENTION

Field of the Invention

The present invention relates to an electrical contact, and more particularly, to an electrical contact used in a burn-in test socket and having an enclosure member, an upper contact pin and a lower contact pin moveably assembled in the enclosure member.

U.S. Pat. No. 6,743,043, issued to Yamada on Jun. 1, 2004, discloses a socket connector for an electrical equipment. The socket comprises a socket body and a plurality of contact pins which are provided for the socket body and by which an electrical equipment having terminals and a printed circuit board are electrically connected. The socket body has a lower plate to be mounted to the printed circuit board and an upper plate which is disposed on the lower plate. The upper plate has a seating portion on which the electrical part is placed in a contacting manner. The lower plate and the upper plate are formed with a plurality of lower side through holes and a plurality of upper side through holes, respectively. The contact pin is inserted into the lower side through hole and corresponding the upper side through hole.

The contact pin comprises a first plunger electrically connected to the terminal of the electrical part, a second plunger electrically connected to the printed circuit board, a tubular member disposed between the first and the second plungers, and an elastic member. The elastic member and the tubular member are disposed between the first and the second plungers. The elastic member compels the first and second plungers away from each other such that both the first and second plungers extend beyond the tubular member.

In assembling, the first plunger is firstly inserted into the upper side through hole of the upper plate from a bottom side thereof. Then, the tubular member is fitted into the upper side through hole of the upper plate. After that, the second plunger is inserted the lower side through hole of the lower plate from a top side thereof. Finally, the elastic member is disposed between the upper surface of a stopper portion of the second plunger and a lower opened end peripheral edge of the tubular portion. Thus the contact pin is assembled between the upper side through hole and the lower side through hole. Obviously, the first plunger, the second plunger, the elastic member and the tubular member are separately assembled to the socket body, respectively, that makes the assembly become laborious and increase a manufacturing cost of the socket.

Hence, it is desirable to provide an improved electrical contact to overcome the aforementioned disadvantages.

SUMMARY OF THE INVENTION

An object of the present invention is to provide an electrical contact comprising an enclosure member, an upper contact pin and a lower contact pin both movably assembled in the enclosure member to simplify the assembly process of the electrical contact.

In order to achieve the above-mentioned object, an electrical contact comprises an enclosure member having a tubular portion defining grooves on thereof, an upper contact pin movable assembled on one end of the enclosure member, a lower contact pin movable assembled on another end of the enclosure member, and a spring inserted within the enclosure member and between the upper and lower contact pins. The upper contact pin has a base portion, an upper contacting portion extending upwardly from the base portion, and a pair of supporting slides extending outwardly from two sides of the base portion. The lower contact pin comprises a main body, a lower contacting portion extending downwardly from the main body, and a pair of supporting slides extending outwardly from two sides of the main body. The supporting slides of the upper contact pin and the lower contact pin being received in the grooves of the enclosure member and movable up and down along the grooves in a vertical direction.

Other features and advantages of the present invention will become more apparent to those skilled in the art upon examination of the following drawings and detailed description of preferred embodiments.

DETAILED DESCRIPTION OF PREFERRED EMBODIMENT

Figure 1:
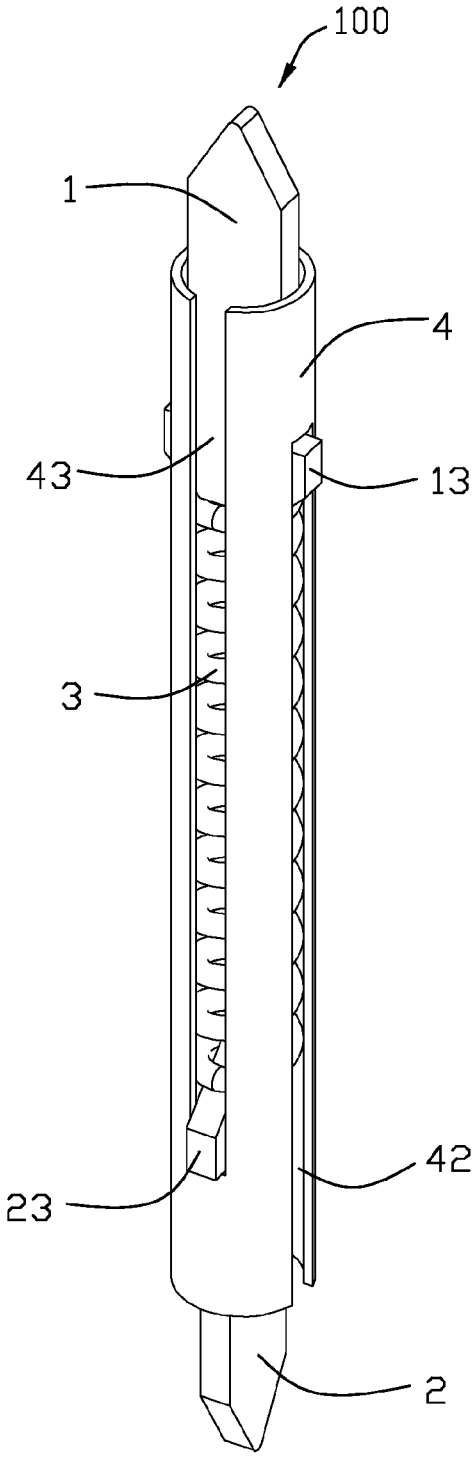
FIG. 1 is an assembled perspective view of an electrical contact in accordance with the present invention.

Reference will now be made to the drawing figures to describe the preferred embodiments of the present invention in detail.

Figure 2:
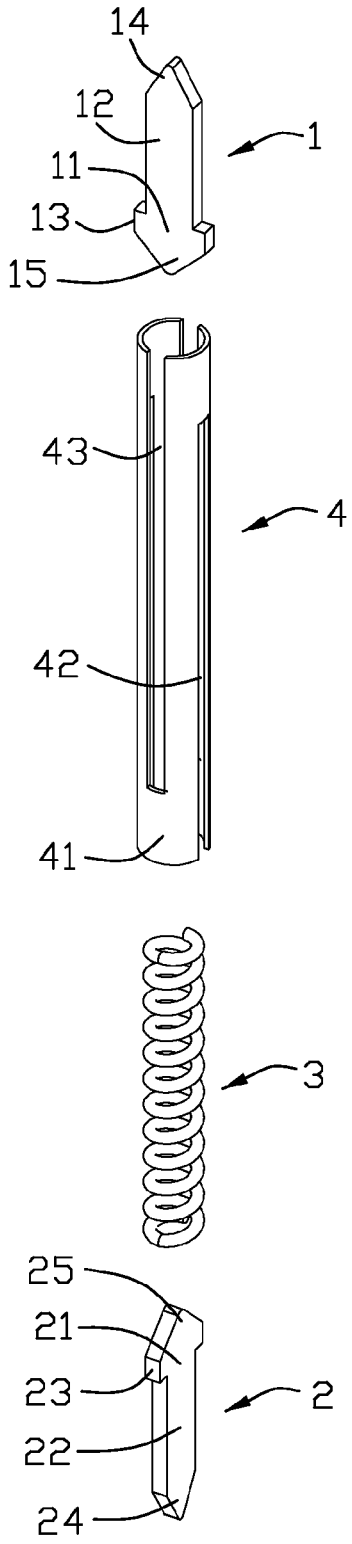
FIG. 2 is an exploded perspective view of the electrical contact of FIG. 1.

Referring to FIGS. 1 to 2, an electrical contact 100 of a preferred embodiment in accordance with the present invention is adapted for being arranged in a test socket or a burn-in socket for receiving an IC package and electrically connecting the IC package to a PCB for testing an IC package when it is seated onto the socket. In such a state, the test socket performs a performance test to the IC. The electrical contact 100 comprises an enclosure member 4, an upper contact pin 1, a lower contact pin 2, and a spring 3 disposed between the upper contact pin 1 and the lower contact pin 2. The enclosure member 4 envelops over the upper contact pin 1, the lower contact pin 2 and the spring 3, and the upper contact pin 1 and the lower contact pin 2 are respectively assembled on two ends of the enclosure member 4.

As shown in FIGS. 1 and 2, the enclosure member 4 envelops the upper contact pin 1, the lower contact pin 2, and the spring 3. The enclosure member 4 has a cylindrical configuration. The enclosure member 4 comprises a tubular portion 41 having both ends not caulked, a pair of first grooves 42 and a pair of second grooves 43 defined on the tubular portion 41. Each pair of first groove 42 and second groove 43 are symmetrically arranged and define openings at two opposite ends. A surface defined by the first grooves 42 is vertical to another surface defined by the second grooves 43.

Figure 3:
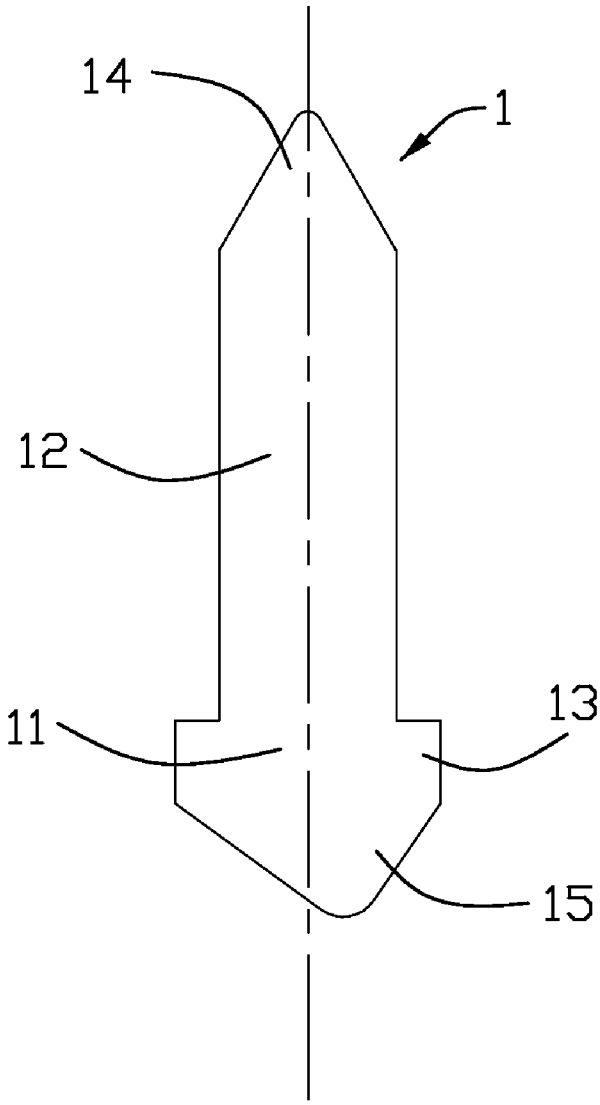
FIG. 3 is a perspective view of an upper contact pin of the electrical contact of FIG. 1.

As shown in FIGS. 2 and 3, the upper contact pin 1, stamped from a metal piece, includes a base portion 11, a slender upper contacting portion 12 extending upwardly from the base portion 11, and a pair of supporting slides 13 extending outward from two sides of the base portion 11 to abut against a top end of the spring 3. The supporting slides 13 of the upper contact pin 1 are received in the first grooves 42 of the enclosure member 4 and move up and down along the first grooves 42 in a vertical direction. The upper contacting portion 12 has a taper contacting end 14 for contacting with the IC package (not shown). The base portion 11 further comprises a taper pressing portion 15 extending downwardly from the base portion 11 to resist against the top end of the spring 3. A sharp point of the pressing portion 15 is deviated from a centerline of the upper contact pin 1 thus the pressing portion 15 is not arranged symmetrically.

Referring to FIG. 2, the lower contact pin 2 is also produced from a sheet metal and has a similar structure of the upper contact pin 1. The lower contact pin 2 also includes a main body 21, a lower contacting portion 22 extending downwardly from the main body 21, and a pair of supporting slides 23 extending outwardly from two sides of the main body 21. The supporting slides 23 of the second contact pin 2 are received in the second grooves 43 of the enclosure member 4 and also move up and down along the second grooves 43 in a vertical direction. The lower contacting portion 22 has a taper contacting end 24 for connecting with the PCB (not shown). A taper pressing portion 25 extends upwardly from the main body 21 to bias against the bottom end of the spring 3. The pressing portion 25 has a symmetrical configuration.

The spring 3 is disposed within the enclosure member 4. The top end and the bottom end of the spring 3 respectively abut against the pressing portion 15 of the upper contact pin 1 and the pressing portion 25 of the lower contact pin 2. Thus, the spring 3 is disposed between the upper contact pin 1 and the lower contact pin 2 and compels the two from each other.

Figure 4:
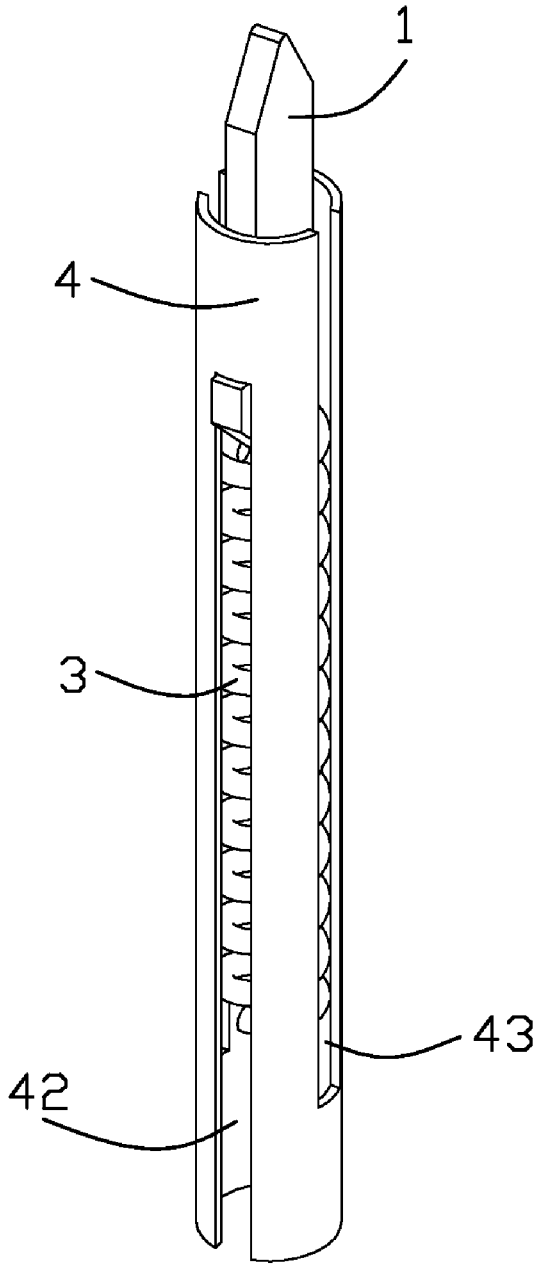
FIG. 4 is an assembled perspective view of the upper contact pin and a spring assembled in a tubular member of the electrical contact of FIG. 1.
Figure 5:
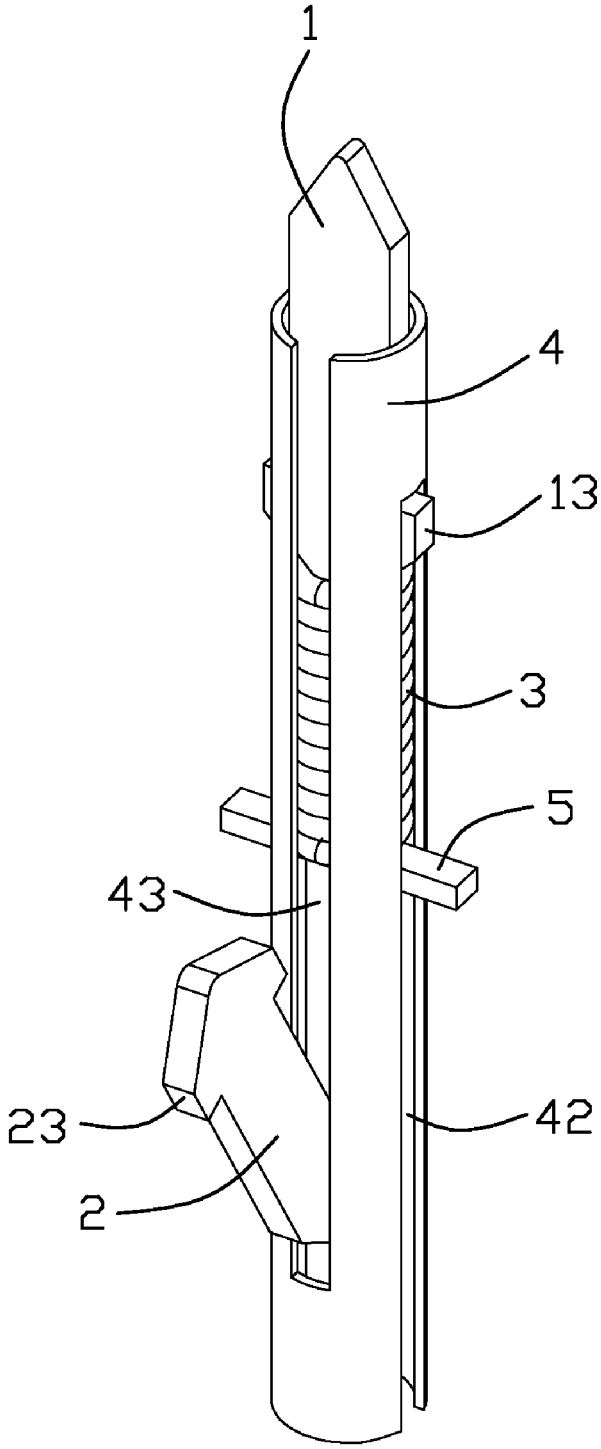
FIG. 5 is a sketch view, showing a lower contact pin of the electrical contact being partially assembled in the tubular member of the electrical contact.

Referring to FIGS. 4 and 5, the assembling process of the electrical contact 100 is described as following. Firstly, the upper contact pin 1 is inserted into the first grooves 42 from a lower side of the first grooves 42, and the then spring 3 is assembled in the enclosure member 4 from the bottom side thereof and abuts against the pressing portion 15 of the upper contact pin 1. Secondly, a rectangle sheet 5 is put passing through the first grooves 42. The sheet 5 is disposed under the bottom end of the spring 3. The spring 3 is pushed upwardly by the sheet 5 so as to form a room for receiving the lower contact pin 2. Then the lower contact pin 2 is assembled in the second grooves 43. Finally, the sheet 5 is taken out and the spring 3 is released. The bottom end of the spring 3 abuts against the pressing portion 25 of the lower contact pin 2. At this time, the upper contact pin 1 and the lower contact pin 2 are assembled within the enclosure member 4 and can move up and down along the tubular portion 41 in the vertical direction. The supporting slides 13 and 23 can prevent the upper contact pin 1 and the lower contact pin 2 from moving out of the enclosure member 4.

When the electrical contact 100 is in use, the upper contact pin 1 and the lower contact pin 2 are respectively depressed by the IC package and the PCB from both ends. Thus, the upper contact pin 1 and the lower contact pin 2 move down and up along the enclosure member 4 in opposite directions to depress the spring 3, and hence, electrical interconnections therebetween can be ensured. When compressing force is not released on the electrical contact 100, the extension of the spring 3 compels the upper contact pin 1 and the lower contact pin 2 return to a normal state.

The electrical contact 100 of the present invention has at least some advantages as follow. The enclosure member 4 defines the first grooves 42 and the second grooves 43 to make the upper contact pin 1 and the lower contact pin 2 movably assembled in the enclosure member 4. So, it can simplify the assembly process of the electrical contact 100 and provide a better electrical connection. In addition, the upper contact pin 1 and the lower contact pin 2 can be stamped from a metal sheet and need no additional mechanical workout so as to reduce a manufacturing cost of the electrical contact 100.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical contact comprising:

an enclosure member having a tubular portion defining grooves on thereof;

an upper contact pin movable assembled on one end of the enclosure member and having a base portion, an upper contacting portion extending upwardly from the base portion, and a pair of supporting slides extending outwardly from two sides of the base portion and received in the grooves of the enclosure member to be movable up and down along the grooves in a vertical direction;

a lower contact pin movable assembled on another end of the enclosure member and comprising a main body, a lower contacting portion extending downwardly from the main body, and a pair of supporting slides extending outwardly from two sides of the main body and received in the grooves of the enclosure member to be movable up and down along the grooves in the vertical direction; and a spring inserted within the enclosure member and disposed between the upper contact pin and the lower contact pin, the spring abutting against the base portion of the upper contact pin and the main body of the lower contact pin, respectively.

2. The electrical contact as described in claim 1, wherein each of the grooves defines an opening at one end of the enclosure member.

3. The electrical contact as described in claim 2, wherein the grooves include a pair of first grooves for receiving the upper contact pin and a pair of second grooves for receiving the lower contact pin.

4. The electrical contact as described in claim 3, wherein each pair of first groove and second groove are symmetrically arranged and define the openings at one of two opposite ends.

5. The electrical contact as described in claim 4, wherein a surface defined by the first groove is vertical to another surface defined by the second grooves.

6. The electrical contact as described in claim 5, wherein the upper contact pin is vertical to the lower contact pin after being assembled in the grooves of the enclosure member.

7. The electrical contact as described in claim 6, wherein both the contacting portions of the upper contact pin and the lower contact pin have taper contacting ends.

8. The electrical contact as described in claim 1, wherein the upper contact pin includes a taper pressing portion extending downwardly from the base portion to resist against a top end of the spring, the lower contact pin includes a taper pressing portion extending upwardly from the main body to resist against a bottom end of the spring.

9. The electrical contact as described in claim 8, wherein the pressing portion of the upper contact pin is not in a symmetrical shape, and a sharp point of the pressing portion is deviated from a centerline of the upper contact pin.

10. The electrical contact as described in claim 8, wherein the pressing portion of the lower contact pin has a symmetrical configuration.

11. An electrical contact used for a burn-in test socket, comprising:

an enclosure member comprising a hollow tubular portion defining at least two pair of grooves thereof;

an upper contacting pin inserted into a top end of the tubular portion and being movably assembled in one pair of the grooves of the enclosure member and having an upper contacting portion;

a lower contact pin inserting into a bottom end of the tubular portion and being movably assembled in another pair of the grooves of the enclosure member and having a lower contacting portion; and a spring disposed within the tubular portion of the enclosure member and between the upper contacting pin and the lower contacting pin.

12. The electrical contact as described in claim 11, wherein the grooves include a pair of first grooves for receiving the upper contact pin and a pair of second grooves for receiving the lower contact pin.

13. The electrical contact as described in claim 12, wherein a surface defined by the first groove is vertical to another surface defined by the second groove.

14. The electrical contact as described in claim 12, wherein the upper contact pin has a base portion, and a pair of supporting protrusions extending outwardly from two sides of the base portion to engage with one end of the first grooves.

15. The electrical contact as described in claim 12, wherein the lower contact pin comprises a main body, and a pair of supporting protrusions extending outwardly from two sides of the main body to engage with one end of the second grooves.

16. An electrical contact comprising:

a tubular enclosure defining an inner receiving space between opposite first and second ends thereof;

a first diametrical slot extending from the first end toward and terminated before reaching the second end;

a second diametrical slot extending from the second end toward and terminated before reaching the first end;

a first blade type contact pin received in the receiving space with two opposite side edges moving along the first diametrical slot;

a second blade type contact pin received in the receiving space with two opposite side edges moving along the second diametrical slot; and a spring means constantly urging the first blade type contact pin toward the second end and urging the second blade type contact pin toward the first end.

17. The electrical contact as claimed in claim 16, wherein said spring is sandwiched between the first blade type contact pin and the second blade type contact pin.

18. The electrical contact as claimed in claim 16, wherein said spring means is unitary.

19. The electrical contact as claimed in claim 16, wherein said first blade type contact pin and said second blade type contact pin are axially space from each other with a distance.

* * * * *